United States Patent [19]

Taylor

[11] 4,344,301

[45] Aug. 17, 1982

[54] BEVERAGE COOLER CONSTRUCTION

[76] Inventor: Frank Taylor, 9415 Central St., LaSalle, Quebec, Canada, H8R 2K4

[21] Appl. No.: 180,853

[22] Filed: Aug. 25, 1980

[51] Int. Cl.[3] ..... F25D 3/08

[52] U.S. Cl. ..... 62/457; 62/371; 62/529

[58] Field of Search ..... 62/371, 372, 457, 529, 62/530

[56] References Cited

U.S. PATENT DOCUMENTS

| | | | |
|---|---|---|---|
| 2,393,245 | 1/1946 | Hadsell | 62/457 X |
| 2,496,296 | 2/1950 | Lobl | 62/457 |
| 3,255,607 | 6/1966 | Bair et al. | 62/457 X |
| 3,406,532 | 10/1968 | Rownd et al. | 62/457 |
| 3,971,231 | 7/1976 | Derry | 62/457 X |
| 4,024,731 | 5/1977 | Branscum | 62/457 |

*Primary Examiner*—Lloyd L. King

[57] ABSTRACT

A portable beverage cooler comprising a hollow body having a bottom wall, opposed side walls and an open end. A lid is provided for closing the open end. The hollow body and the lid are each formed of a material having thermal insulating properties. Engagement means is provided in opposed ones of a pair of the side walls of the hollow body for vertically supporting a coolant container spaced adjacent a respective one of the other two opposed side walls and in an upper portion of the body above the bottom wall whereby a plurality of beverage containers may be placed in a lower level portion of the body with the coolant containers held thereabove and defining between them an upper level portion for containment of further beverage containers resting on the containers in the lower level portion. Such disposition of the beverage containers provides for convection of cooled air by the coolant containers to all of the beverage containers to maintain them at substantially the same temperature during a given period of time.

10 Claims, 4 Drawing Figures

BEVERAGE COOLER CONSTRUCTION

BACKGROUND OF INVENTION (a) Field of the Invention

This invention relates to polyfoam coolers generally used to carry food and beverages to picnics and similar outings, and more particularly to an improved cooler of the type using cold packs to provide the coolant and for use exclusively for carrying canned or bottled beverages only and wherein the temperature of such beverages can be maintained at a cool temperature for many hours.

(b) Description of Prior Art

Polyfoam coolers, to a large degree, are simply moulded box forms having a body and lid. When food and drink items have been chilled and placed in such coolers, the insulated container restricts the flow of heat from ambient air, thus keeping the contents cool for a period of time. To assist in this process, generally one or more cold packs are also employed, these being plastic containers having a coolant substance, such as common or artificial ice. This arrangement, by and large, is not very efficient due to the fact that when the food and drink items are placed together in such coolers, the beverages, being at a lower temperature than the food items, absorb heat from the food and the temperature of such beverages rises undesirably. When cold packs are used in these instances, their effectiveness is thus limited by the presence of the food items and also by such items restricting the flow of cold convection air from the cold pack to around the beverages.

When polyfoam coolers are designed for beverages only, better results are obtained, particularly if a coolant medium is employed. From the standpoint of endeavouring to obtain the coldest possible beverage temperature for the longest period of time, larger coolers, with the beverages packed in loose ice provides good results. However, considerable excess weight must be contended with along with the messy ice and water, and not forgetting the disadvantage of the large size of the cooler.

The ideal drinking temperature of common beverages, such as beer, soft drink, fruit juice, etc., is that provided by a home refrigerator and which reduces and maintains liquid temperatures to about 40° F. An ideal concept for a beverage cooler, therefore, would be one which receives canned or bottled beverages directly from the home refrigerator and continuously performs the same function, i.e., keeping the beverages at the same temperature as in the refrigerator for a prolonged period of time, for example, eight hours or more. In other words, such a cooler would be, in effect, a portable extension of the home refrigerator with respect to beverages.

SUMMARY OF INVENTION

According to a feature of the present invention, there is provided a portable beverage cooler capable of containing precooled beverage containers at a predetermined cooled temperature for a prolonged period of time.

A further object of the present invention is to provide a portable beverage cooler capable of storing twelve conventional cans of beverages at 40° F. and containing two coolant containers therein whereby the total b.t.u. per hour input to the interior of the cooler from the ambient air, at for example, 80° F., is exactly counterbalanced by the total b.t.u. per hour absorption of the two coolant containers, thereby keeping the enclosed beverage containers from absorbing any heat or giving off any heat in the interior of the cooler.

Another feature of the present invention is to provide a portable beverage cooler which is of convenient carrying size and is hand portable and provides ready access to all of its beverage container contents.

Another feature of the present invention is the employment of a coolant liquid having a freezing temperature of 25° F. to provide the coolant performance necessary to the design requirement; such coolant liquid not requiring to be provided with the cooler but rather formulated at home by the user by employing table salt and tap water at practically no cost, thereby reducing shipping weight and product cost.

Yet another feature is to provide a carrying handle for the cooler, which, when in the stored (down) position, is contained entirely within the exterior dimensions of the cooler when the cooler lid is in place.

According to the above features, from a broad aspect, the present invention provides a portable beverage cooler comprising a hollow body having a bottom wall, opposed side walls and an open end. A lid is provided for closing the open end. The hollow body and the lid are each formed of a material having thermal insulating properties. Engagement means is provided in opposed ones of a pair of the side walls of the hollow body for vertically supporting a coolant container spaced adjacent a respective one of the other two opposed side walls and in an upper portion of the body above the bottom wall whereby a plurality of beverage containers may be placed in a lower level portion of the body with the coolant containers held thereabove and defining between them an upper level portion for containment of further beverage containers resting on the containers in the lower level portion. Such disposition of the beverage containers provides for convection of cooled air by the coolant containers to all of the beverage containers to maintain them at substantially the same temperature during a given period of time.

BRIEF DESCRIPTION OF DRAWINGS

These and other advantages of the cooler of the present invention will be seen and appreciated by reference to the following description of a preferred embodiment illustrated by the accompanying drawings, in which.

DESCRIPTION OF PREFERRED EMBODIMENTS

Figure 1:
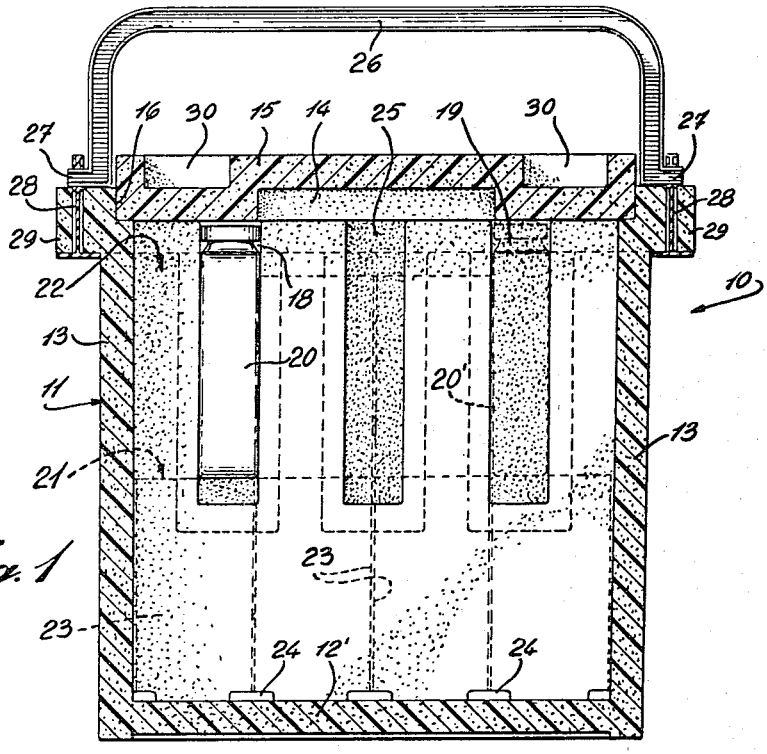
FIG. 1 is a sectionalized elevation of the body and lid of the cooler.
Figure 2:
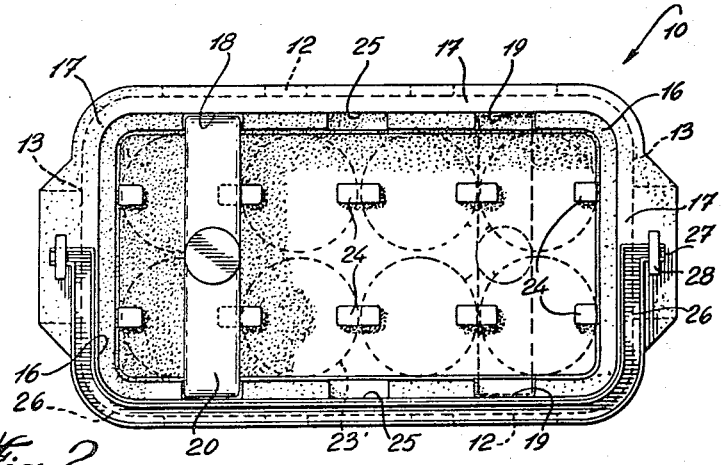
FIG. 2 is a plan view of the cooler body with the lid removed and the carrying handle in the down position.

Referring now to FIGS. 1 and 2, there is shown generally at 10, the portable beverage cooler of the present invention. The cooler comprises essentially a hollow body 11 of substantially rectangular horizontal cross section and having a pair of elongated rectangular parallel side walls 12 and two opposed parallel end walls 13. The upper portion of the body 11 has an open end 14 which is closed by a removable lid 15 which is in friction fit with an inner recess 16 provided in a circumferential inner edge of a circumferential ridge 17 provided about the cooler upper end.

Engagement means in the form of two pairs of opposed vertical slots 18 and 19 are provided in the pair of elongated side walls 12 and each opposed slot of each pair of slots receive a coolant container 20 and 20' in sliding fit therein whereby the coolant containers 20 extend transversely across the opposed elongated side walls and spaced a predetermined distance from the end walls 13.

The hollow body 11 is divided in a lower level portion 21 and an upper level portion 22 to receive a plurality of cylindrical beverage containers 23 in the lower level portion and a further plurality of cylindrical beverage containers 23' in the upper portion thereof but intermediate the coolant containers 20 and 20'.

As herein shown, for the dimensions of the cooler, there are eight beverage containers of 12 oz. each disposed in the lower level portion 21 in two rows of four containers. Four such containers 23' are disposed in the upper level in two rows of two containers. Pedestals 24 are moulded integral with the bottom wall 12 and project inwardly of the hollow body 11 whereby to support the lower end of the beverage containers 23 elevated from the bottom wall 12 to permit the convection of cold air under the containers.

In order to permit access to the end ones of the containers 23 in the lower level portion 21 of the cooler, after the containers 23' in the upper portion have been consumed, there is further provided an intermediate pair of vertical slots 25 disposed centrally along the inner face of the elongated parallel side walls 12 whereby one of the coolant containers 20 or 20' may be positioned therein to permit access of the two end ones of the containers 23 positioned thereunder. As shown in FIG. 1, all of the vertical slots 18, 19 and 25 extend to a position slightly below the top end of the lower level portion 21 whereby the coolant containers 20 and 21 will have their bottom ends resting on the top wall of the beverage containers 23.

A carrying handle 26 having an elongated U shape is hingeably secured at opposed ends 27 to an attachment bracket 28 which is secured in an enlarged ridge portion 29 adjacent the end walls 13. In the unused or down position, as shown in FIG. 2, the handle is contained within the exterior dimensions of the cooler body.

Figure 3:
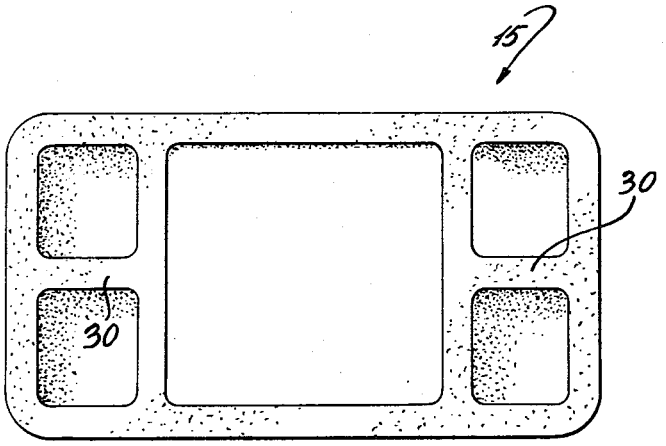
FIG. 3 is a top view of the lid.

As shown in FIG. 3, the lid 15 is of a rectangular shape and dimensioned for friction fit within the inner circumferential recess 16 formed in the inner face of the top circumferential ridge 17 as previously described. Finger gripping means in the form of upstanding ribs 30 provide for the removal of the lid from engagement with the hollow body 11. As shown in FIG. 1, the lid 15 sets into the peripheral ridge 17 to a depth equal to about half its thickness, the other half projecting above the top level of the cooler body.

The cooler functions on the principle of convection currents of cold air generated from both vertical faces of both coolant containers 20 and 20' circulating in a free unrestricted manner completely around each and every beverage container in the cooler thus keeping all twelve containers in the cooler at substantially the same temperature, (a differential of only one degree is quite normal, particularly during the first eight hours of cooling).

The containers 23, as placed on the pedestals, herein ¼ inch high, and only in point contact with the cooler body or each other, are thus almost literally suspended in air, and due to their round shape, provide an ideal environment for the movement of convection currents generated by the coolant containers 20 and 20', the normal temperature of which is about 15° F. below that of the beverage containers.

The preferred coolant is tap water mixed with table salt (sodium chloride) in such proportion as to reduce the freezing temperature of the water to about 25° F. It will be appreciated by those skilled in the art that the melting temperature of the coolant and thus the exterior temperature of the coolant containers remain substantially constant until almost all of the coolant has melted. Other coolant mediums, such as artificial ice may be employed, if desired, provided they meet or exceed the requirement.

The placement of the coolant containers 20 and 20' adjacent the top four beverage containers also holds such containers upright, to completely expose their outer surfaces and to equalize the temperature of the top four containers with that of the bottom eight containers. It will be noted that after the middle eight beverage containers have been consumed, four from the top level portion 22 and four from the bottom level portion 21, either the left or right hand coolant containers 20 or 20' may be shifted to the intermediate recess position in the cooler body to provide access to the other beverage containers in the ends of the lower level portion.

Figure 4:
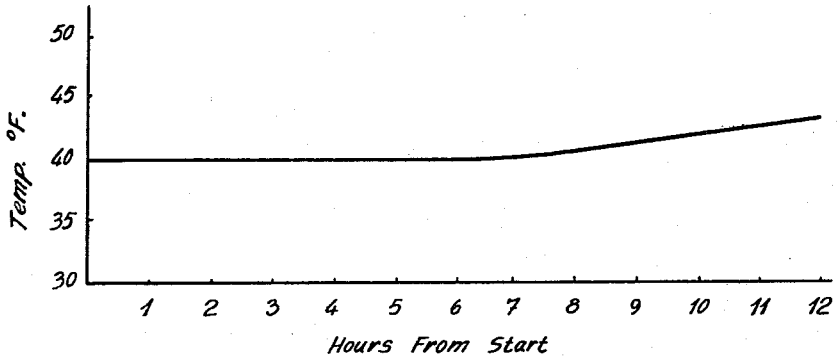
FIG. 4 is a graph showing the performance of the cooler over a predetermined period of time.

FIG. 4 illustrates the result of actual tests made using temperature probes on a model cooler constructed according to the following specifications. The cooler body 11 and the lid 15 were formed of ¾" thick polyfoam, "K" factor 0.25. The coolant containers 20 and 20' were made of blow moulded polyethylene. The coolant in each container 20 and 20' was 16 oz. of brine having a freezing temperature of 25° F. The beverages were twelve 12 oz. cans of beer cooled to exactly 40° F. The ambient temperature was approximately 80° F.

It can be seen that exceptional results were obtained with this design since all factors which may be influential in the performance of the cooler as an extension of the home refrigerator are correlated and controlled. The only variable not under control is the ambient temperature. Since this particular embodiment of the invention is based upon an assumed ambient of 80° F., its performance should be quite acceptable under most summer temperatures, providing, of course, that these coolers, as applies to other designs, are not placed in the sun. For higher average temperatures, modifications may be made to the cooler design without departing from the spirit and scope of the invention as defined by the appended claims, for example, thicker cooler walls, more coolant, etc.

I claim:

1. A portable beverage cooler comprising a hollow body having a bottom wall, opposed side walls and an open end; a lid for closing said open end, said hollow body and lid being formed of a material having thermal insulating properties, engagement means in opposed ones of a pair of said side walls for vertically supporting a coolant container spaced adjacent a respective one of said other two opposed side walls of said body and in an upper portion of said body above said bottom wall whereby a plurality of beverage containers may be placed in a lower level portion of said body with said coolant containers held thereabove and defining between them an upper level portion for containment of further beverage containers resting on said containers in said lower level portion, such disposition of said beverage containers providing for convection of cooled air by said coolant containers to all said beverage containers to maintain them at substantially the same temperature during a given period of time.

2. A cooler as claimed in claim 1 wherein said beverage containers are vertically disposed in said body, said coolant containers having opposed substantially parallel cooling surfaces, inner ones of said cooling surfaces being closely spaced to said upper level beverage containers and outer ones of said cooling surfaces being spaced from said other two opposed side walls.

3. A cooler as claimed in claim 2 wherein said coolant containers are of rectangular shape, said engagement means being constituted by two pairs of opposed vertical slots in said one pair of side walls to receive a coolant container in sliding fit between each opposed ones of said one pair of side walls.

4. A cooler as claimed in claim 3 wherein said pair of side walls having said vertical slots are elongated parallel side walls, said other two opposed side walls being parallel end walls, said hollow body having a rectangular horizontal cross-section.

5. A cooler as claimed in claim 4 wherein said hollow body is capable of containing twelve beverage cylindrical cans of 12 oz. each, there being eight said cans disposed side-by-side vertically in two rows in said lower level portion, and four said cans disposed in two rows of two cans in said upper level portion between said two coolant containers and supported on said cans in said lower level.

6. A cooler as claimed in claim 5 wherein a plurality of upstanding pedestals are moulded integral with said bottom wall of said body and extend inwardly therein to support a lower end of said cans elevated from said bottom wall for the convection of cold air thereunder.

7. A cooler as claimed in claim 4 wherein there is further provided an intermediate pair of vertical slots in said side walls having said two pairs of slots, said intermediate pair of slots being positioned midway between said two pairs of slots to retain one of said coolant containers therebetween for access to beverage containers positioned under either one of said two pairs of slots.

8. A cooler as claimed in claim 4 wherein a top circumferential ridge is provided about said body open end, said ridge defining an inner recessed circumferential seating edge to receive a peripheral portion of said lid in friction fit thereon, and finger gripping means in a top face of said lid for removal of said lid from its frictional retention over said body open end.

9. A cooler as claimed in claim 8 wherein there is further provided a carrying handle hingeably secured to said circumferential ridge and extending across said opposed parallel end walls, said handle being displaceable to a storage position resting onto a half section of said circumferential ridge.

10. A cooler as claimed in claim 5 wherein said body and said lid are mounded from a ¾ inch polyfoam material and said coolant containers are of predetermined size and frozen to 25° F. to permit said twelve cans to remain at substantially the same precooled temperature of 40° F. for a period of about eight hours and rising not more than 5° F. in a twelve hour period with said lid remaining engaged with said body open end.

* * * * *